US006520359B2

(12) United States Patent
Richter et al.

(10) Patent No.: US 6,520,359 B2
(45) Date of Patent: Feb. 18, 2003

(54) LATERAL BOOM LOCKING AND ACTUATING UNIT

(75) Inventors: Frank Richter, Wilhelmshaven (DE); Dieter Stuehrwoldt, Wilhelmshaven (DE); Jens Ennen, Oldenburg (DE)

(73) Assignee: Grove U.S. LLC, Shady Grove, PA (US)

( * ) Notice: Subject to any disclaimer, the term of this patent is extended or adjusted under 35 U.S.C. 154(b) by 0 days.

(21) Appl. No.: 09/849,993

(22) Filed: May 8, 2001

(65) Prior Publication Data

US 2001/0052506 A1 Dec. 20, 2001

(30) Foreign Application Priority Data

May 8, 2000 (DE) ..... 100 22 373

(51) Int. Cl.[7] ..... B66C 23/04
(52) U.S. Cl. ..... 212/292; 212/348; 52/118
(58) Field of Search ..... 212/292, 348, 212/349, 350; 52/118

(56) References Cited

U.S. PATENT DOCUMENTS

| | | | | | |
|---|---|---|---|---|---|
| 2,373,480 | A | | 4/1945 | Lambert | |
| 2,589,080 | A | * | 3/1952 | Heinish | 189/14 |
| 2,726,066 | A | | 12/1955 | Lear et al. | |
| 2,829,741 | A | * | 4/1958 | Selberg et al. | 189/14 |
| 3,366,407 | A | * | 1/1968 | Cernosek | 287/58 |
| 3,503,642 | A | | 3/1970 | Poe | |
| 3,631,988 | A | * | 1/1972 | Noly | 212/46 |
| 3,727,359 | A | * | 4/1973 | Vonck | 52/121 |
| 3,817,397 | A | * | 6/1974 | Wellman | 212/30 |
| 3,921,819 | A | * | 11/1975 | Spain | 212/144 |
| 4,036,372 | A | | 7/1977 | Rao et al. | |
| 4,053,058 | A | * | 10/1977 | Jensen et al. | 212/8 R |
| 4,396,126 | A | * | 8/1983 | Moravec et al. | 212/230 |
| 4,688,690 | A | * | 8/1987 | Gattu et al. | 212/268 |
| 5,628,416 | A | | 5/1997 | Frommelt et al. | |
| 5,660,495 | A | * | 8/1997 | Atsukawa | 403/377 |
| 6,216,895 | B1 | | 4/2001 | Erdmann et al. | |
| 6,446,408 | B1 | * | 9/2002 | Gordin et al. | 52/632 |

FOREIGN PATENT DOCUMENTS

| | | | |
|---|---|---|---|
| DE | 3131241 | A1 | 8/1982 |
| DE | 32 14 351 | * | 10/1983 |
| DE | 4344795 | A1 | 12/1993 |
| DE | 19811813 | A1 | 3/1998 |
| EP | 0476225 | A2 | 4/1991 |

* cited by examiner

*Primary Examiner*—Thomas J. Brahan
(74) *Attorney, Agent, or Firm*—Birch, Stewart, Kolasch & Birch, LLP

(57) ABSTRACT

A locking mechanism for telescoping sections, in particular for a mobile crane boom, includes a linearly shiftable locking bolt for connecting and releasing an inner telescoping section with respect to an outer telescoping section, said locking bolt being maintain ed biased in its extended position. The locking bolt is shifted by means of a rotary actuator from its extended position into its retracted position.

20 Claims, 8 Drawing Sheets

LATERAL BOOM LOCKING AND ACTUATING UNIT

BACKGROUND OF THE INVENTION

The invention relates to a locking mechanism for telescoping sections of an apparatus such as a crane boom.

Crane boom telescoping sections may be lockable in the extended condition to relieve the load that would otherwise bear on the telescoping system, among other things. This is called for in particular when entraining means, for example piston/cylinder units, are use to extend the telescoping sections, which extend and retract one telescoping section after the other in sequence. Locking telescoping sections is generally achieved by locking bolts which are mounted on one telescoping section and engage in a receiving location of an adjoining telescoping section.

DESCRIPTION OF BACKGROUND ART

DE 198 11 813 A1 discloses a locking mechanism, in which two respective locking bolts of a locking unit are arranged on an inner telescoping section so that they can be made to engage two opposing receiving locations in the vertical side webs of the adjoining outer telescoping section. The locking mechanism comprises a hydraulic cylinder, arranged parallel to the longitudinal centerline of the telescoping sections, and a lever which shifts the locking bolts upon movement of the actuating cylinder. The engaging end of the lever engages—when the device is positioned at a suitable location as controlled by a position monitor—the inner clasp of the locking bolt so that the locked position can be released by actuating the hydraulic cylinder. The minimum dimensions necessary for the innermost telescoping section are dictated by a) the configuration by the engaging end of the lever and of the inner clasp of the locking bolt, b) the travel necessary to overcome the spacings between outer and inner telescoping section as well as c) the minimum dimensions as dictated by the strength and functioning requirements involved for the locking bolts, their mounting, the clasps of the locking bolt, the lever as well as the actuating cylinder.

SUMMARY OF THE INVENTION

It is an object of the present invention to provide a locking mechanism for telescoping sections which takes up significantly less room than known devices. An object is to enable use of such locking system in substantially smaller telescoping sections of crane booms than hitherto possible. In addition, an object of the invention is to provide a simple and cost-effective locking mechanism for telescoping sections.

In accordance with the invention, a locking mechanism for telescoping sections comprises a linearly shiftable locking bolt for connecting and releasing an inner telescoping section and an outer telescoping section, the locking bolt being maintained biased in its extended position and shifted by means of a rotary actuator from its extended position into its retracted position.

An advantage of an assembly in accordance with the invention is that it can be constructed with relatively small, overall dimensions. Both the height and width of the space required are significantly reduced by using a rotary actuator. Thus, the locking system can be used on substantially smaller telescoping sections of crane booms than hitherto possible. Alternatively, or additionally, the invention frees up space within the confines of a telescoping boom section that may be devoted to other components and/or structural considerations.

The locking bolt may be mounted in an inner telescoping section and protrude in its extended position into the adjoining outer telescoping section so that the telescoping sections cannot be shifted relative to each other axially. In its retracted position, the locking bolt is out of engagement with the outer telescoping section permitting shifting of the telescoping sections relative to each other. Instead of a hydraulic cylinder, a small rotary drive may be used. This rotary drive may be powered in any way, such as hydraulically, electrically or pneumatically. A rotary drive of this kind takes up much less room than a hydraulic cylinder acting on the locking bolt by means of a system of levers. It is particularly preferred to arrange two locking bolts on an inner telescoping section so that they are engageable with two opposing receiving locations in the vertical side webs of the outer telescoping section, i.e. preferably in the middle portion of the side webs.

The rotary actuator may act directly on the locking bolt. It is particularly preferred that the locking bolt is connectable at least temporarily to the rotary actuator via a connecting element.

In a preferred embodiment, the connecting element comprises or is formed as a cam guide or a cam claw. This is particularly advantageous when the connecting element is not intended to be permanently connected to the locking bolt. The cam guide is driven by the rotary actuator to act on the locking bolt which, in keeping with the configuration of the cam of the cam guide, is linearly shifted. Preferably, a cam guide or cam claw is provided which comprises a guiding surface area and which may be easily brought into or out of engagement with the locking bolt. In a particularly preferred embodiment the cam guide is a cam plate.

In a preferred embodiment the invention includes an engaging member associated with the locking bolt, for example, in the form of a pin or a roll. The rotary actuator rotates about an axis that is substantially perpendicular to the direction of shifting of the locking bolt along its own axis. Upon turning of the cam guide, the guiding surface area moves along the engaging member so that the locking bolt is drawn towards and approaches the axis of the rotary actuator.

In accordance with the invention, the cam guide may be preferably disengaged from the locking bolt. This is particularly of advantage when the same rotary actuator and cam guide are to be used for different locking bolts of different telescoping sections. It is particularly preferred that the cam guide can only be disengaged from the locking bolt when the locking bolt is in its extended (locked) position. This enhances the operating safety of a locking action, since the inner telescoping section is never in a "free" state, that is, a state in which the inner telescoping section is connected neither to the outer telescoping section nor to the cam guide. The cam guide can then be caused to engage and disengage respectively with the locking bolt when the locking bolt is in its "safe" extended position.

Preferably, in accordance with the invention, the cam guide can be brought into a passive position, in which the cam guide is disengaged from the locking bolt, and can be shifted relative thereto without engaging the locking bolt. Preferably, the cam guide is locked in its passive position to prevent unintended rotation to enhance safety. Thus, an accidental actuation or disengagement of a locking bolt from a locked position is prevented.

In order to shift the telescoping sections relative to each other, a piston/cylinder unit is typically used. In a typical arrangement the head of the cylinder is connectable with the inner telescoping section and shifts it relative to the outer telescoping section upon actuation of the cylinder. Prior to the inner telescoping section being shifted, the lock between the two telescoping sections is released by moving the locking bolt into its retracted position. Preferably, a release device is provided which is connected to the piston/cylinder unit, preferably at the head of the cylinder at the piston outlet end, and can be shifted along the centerline of the telescoping sections. The release device comprises the rotary actuator and the connecting element and is engageable with the inner end of the locking bolt in order to move the locking bolt against the biasing action from its extended locked position into its retracted disengaged position.

In order that the engaging member of the locking bolt can be caused to reliably engage the guiding surface area of the rotary actuator, the locking bolt is preferably mounted so that it is linearly (axially) shiftable and non-rotatable. A locking bolt having a cornered or oval cross-section may be used. If a cylindrical locking bolt is used, it may be prevented from turning by a groove or a pin.

The cam guide may be held in its passive position by an elastic force, in particular by a spring force. The cam guide can be fixedly located in the passive position by a locking element, in particular a locking pin. The locking element may be employed in addition to the spring force.

By suitably configuring the cam guide and selecting the passive position, the width of the locking mechanism can be reduced to such an extent to reliably avoid any collision with surrounding parts of the locking bolt and parts of the telescoping sections during movement of the piston/cylinder unit in the longitudinal direction of the telescoping sections.

In accordance with another aspect of the invention, the locking bolt may be received or mounted in a receiving location, particularly a bush or bushing, in which an emergency actuator is provided for shifting the locking bolt from its extended position into its retracted position. Thus, an emergency actuator for releasing the locking bolt without the rotary drive is integrated in the receiving location of the locking bolt. Such a feature saves additional space in construction of an apparatus in accordance with the invention. The emergency actuator may comprise an actuating element, in particular a pin, held in the bushing in various axial positions in the axial direction thereof and entraining the locking bolt upon a change in its axial position. The actuating element may be held clamped in various axial positions. It is particularly preferred that the emergency actuating element is connected to the bushing via a screw thread, and can thus be positioned in various axial positions relative to the bushing upon rotation. For this purpose, the actuating element is connected via a screw thread to the side of the bushing facing the cam guide. When the actuating element is fixedly located at the locking bolt and turned around its longitudinal centerline, the screw thread creates a relative movement between the locking bolt and bushing. Configuring the emergency actuator in this way with the bushing integrated in the actuator unit requires substantially less constructional room compared with prior art.

Another preferred aspect of the invention is that the emergency actuator may be configured so that it can be used also as a rotary lock preventing the locking bolt from rotating. Accordingly, the actuating element may be used as an emergency actuator, as a rotary lock or both. The emergency actuator or rotary lock, previously described, may also be used to advantage without a rotary actuation of a cam guide for shifting the locking bolt.

Preferably, the proximity sensors for sensing the relative position of the telescoping sections are directly integrated in the cylinder head. For this purpose, the cylinder head is configured so that the proximity sensors are accommodated in cavities or holes in the cylinder head and electrical connections can be brought out via cable guides inserted in the face of the cylinder head. This results in the proximity sensors taking up little room while, at the same time, accommodating them in a protected manner.

BRIEF DESCRIPTION OF THE DRAWINGS

Preferred embodiments of the present invention will now be detailed by way of the following figures. The features disclosed thereby are preferred further aspects in the disclosed combinations of the claimed invention. In the drawings:

DETAILED DESCRIPTION OF THE PREFERRED EMBODIMENTS

Figure 1:
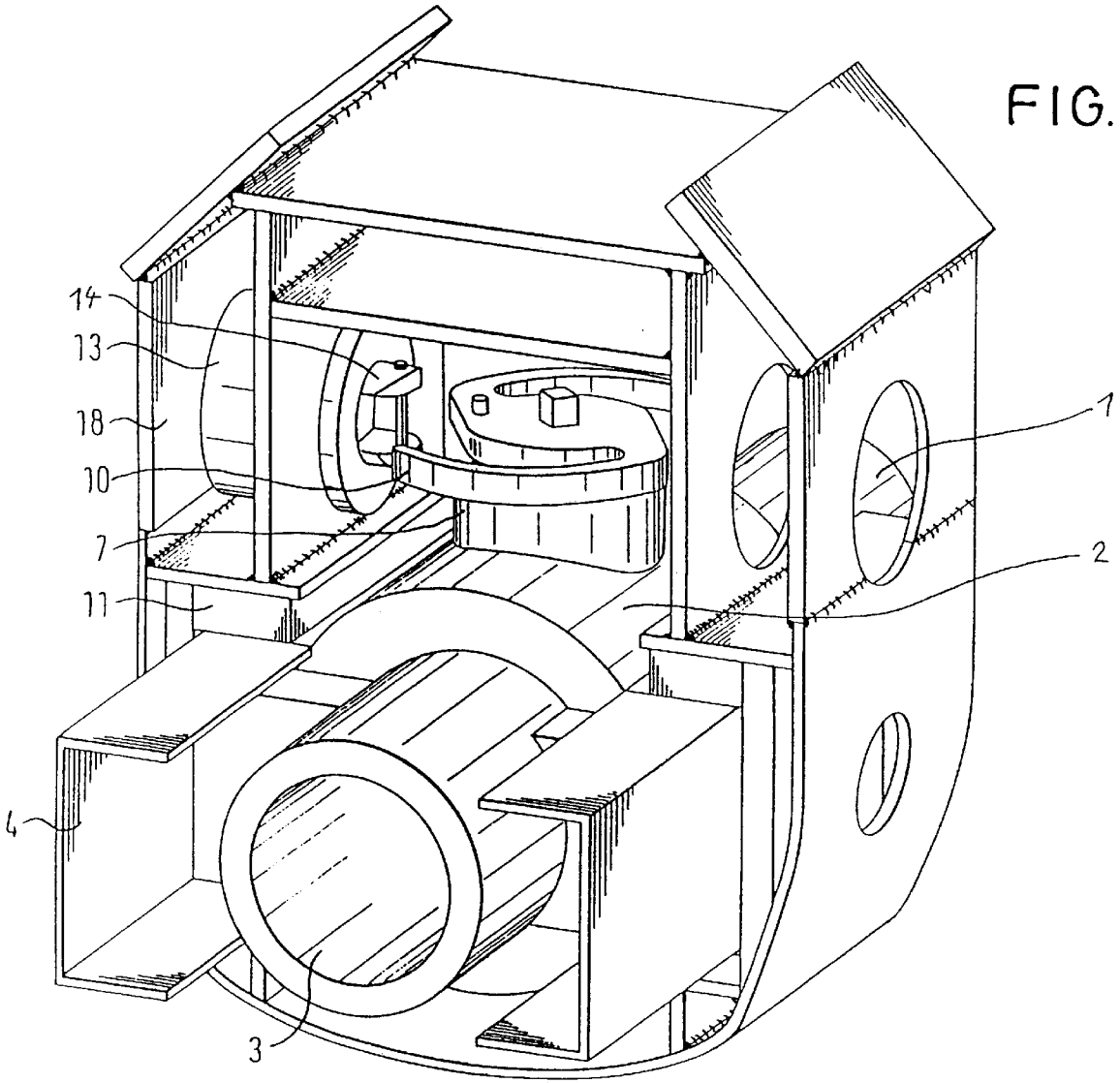
FIG. 1 is a view, partly in section, of an inner telescoping section with a locking mechanism according to the invention integrated therewith.

FIG. 1 illustrates in a perspective view an inner telescoping section 18, which is mounted within an outer telescoping section (not shown). To lock the two telescoping sections relative to each other, locking bolts 14 are provided extending through both the inner and the outer telescoping section. Shown in the drawing is only one locking bolt 14, although preferably two locking bolts 14 are provided. The locking bolt 14 is mounted in a guide bushing 13 mounted in the inner telescoping section 18. The guide bushing 13 is connected to the inner telescoping section 18, preferably in a press fit. The locking bolt 14 is linearly (axially) shiftable within bushing 13 between an extended position and a retracted position transversely to the shifting direction of the telescoping sections. In a typical arrangement, a second locking bolt (not shown) is arranged in the inner telescoping section 18 opposite the locking bolt 14 illustrated in the drawing.

Receiving locations are provided, preferably in the vertical side webs of the outer telescoping section, into which the respective locking bolts can be brought into engagement to thus connect the inner telescoping section to the outer telescoping section when the locking bolts 14 are in their extended position. In this way, the two telescoping sections are interlocked. While the following discussion, by way of example, refers to only one locking bolt, it is to be understood that the same considerations apply to multiple locking bolts.

Figure 8:
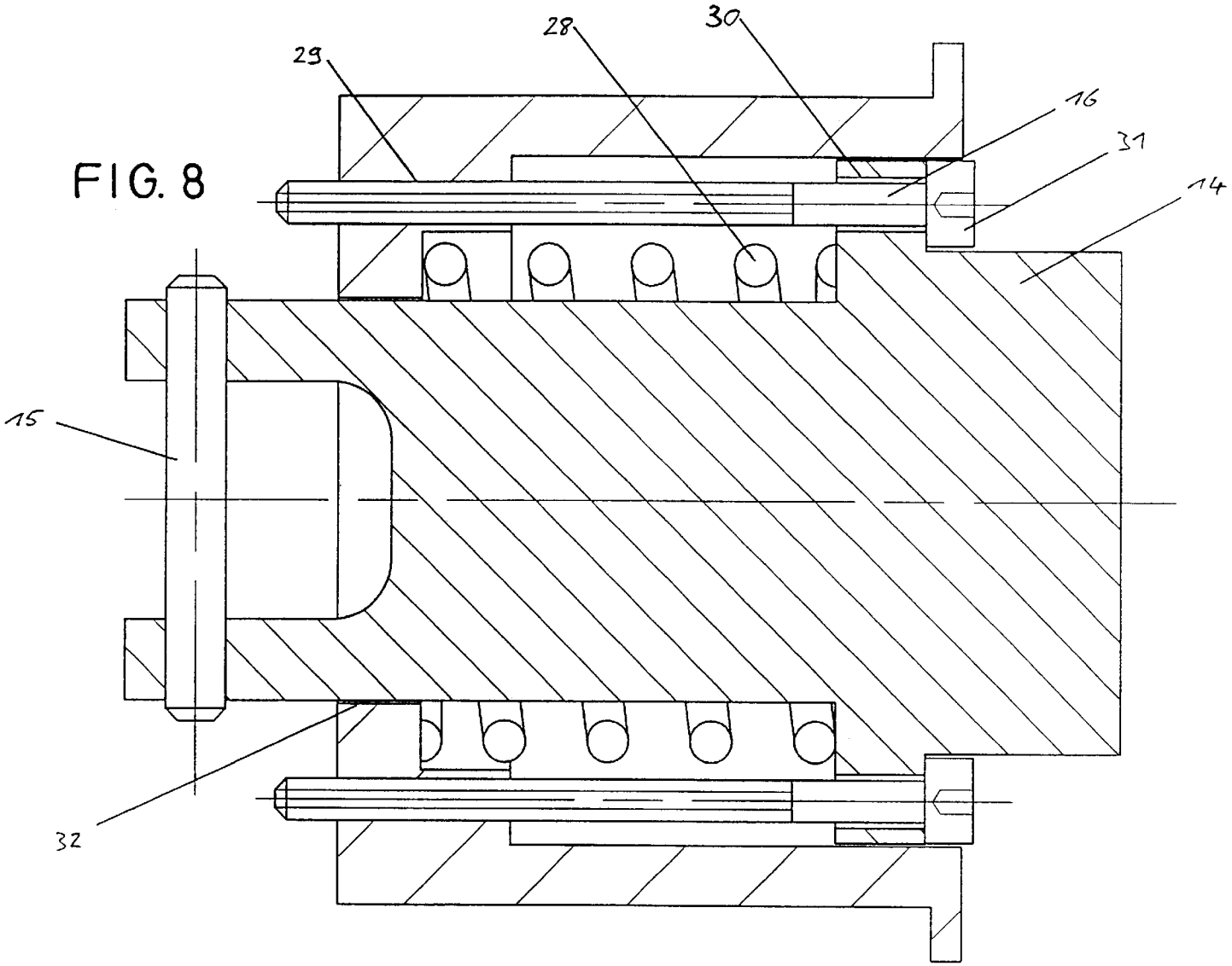
FIG. 8 is a sectional view of the locking bolt with integrated emergency actuator and/or rotary lock.

To prevent accidental release of the locking mechanism, the locking bolt 14 is maintained in its extended position by means of a compression spring 28, as illustrated in FIG. 8. The locking bolt 14 can be moved into its retracted position against the spring force by means of a release device. In the retracted position, the locking bolt 14 no longer engages the outer telescoping section so that the locking mechanism of the telescoping sections is released.

In accordance with the invention, the release device is provided on a head 2 of a piston/cylinder unit 1, 3, in which a piston rod I is shiftable in a cylinder barrel 3. The release device comprises a rotary actuator 7 and a cam plate 10. For unlocking the locking mechanism, the locking bolt 14 is retracted into the interior of the inner telescoping section by means of the cam plate which is caused to turn by the rotary actuator 7. In this way the locking bolt 14 is disengaged from the outer telescoping section.

Figure 2:
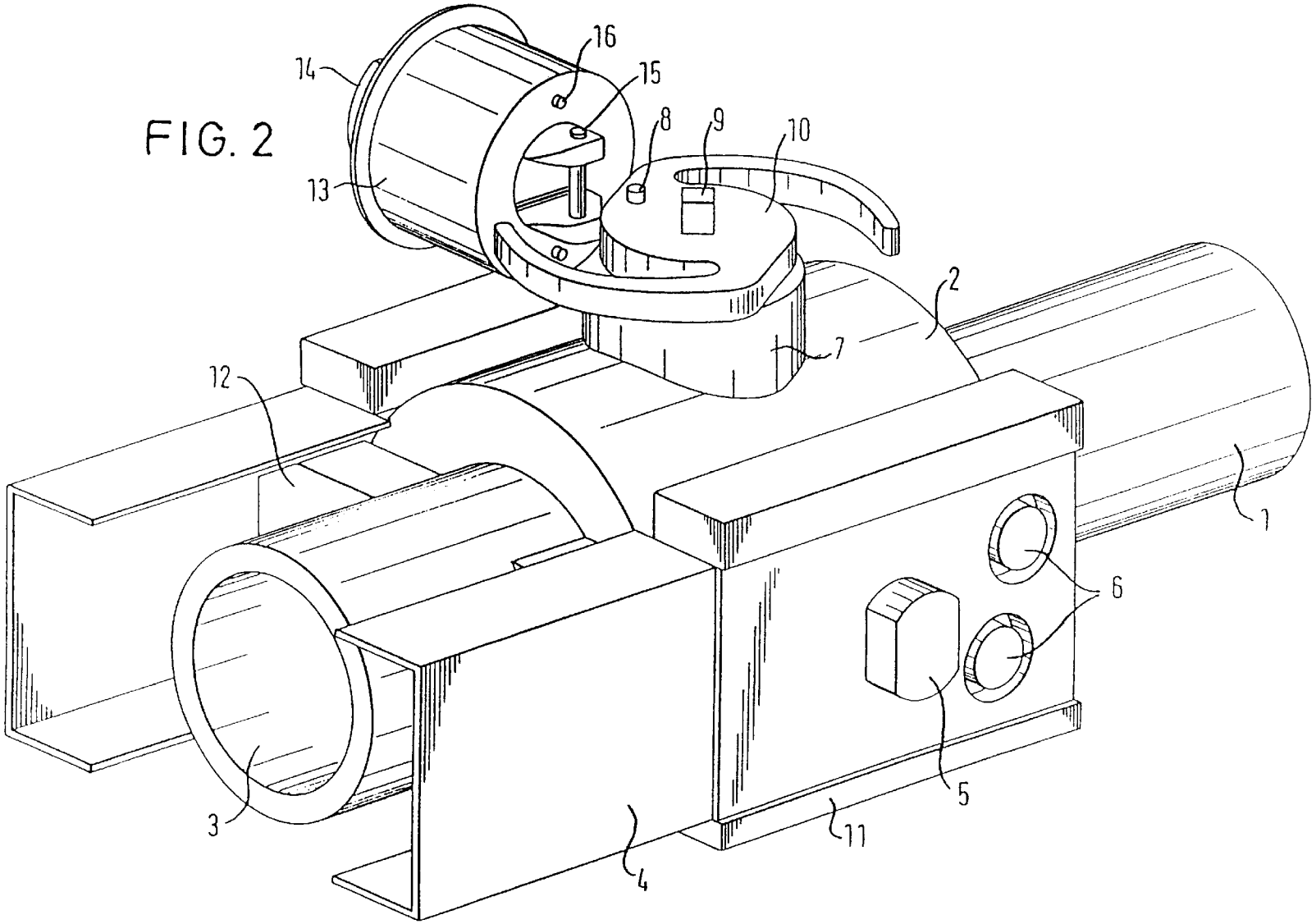
FIG. 2 shows another view of a locking mechanism for telescoping sections, as shown in FIG. 1 but with some portions deleted.

The locking mechanism for the telescoping sections shown in FIG. I is further illustrated in FIG. 2 without the telescoping sections. The rotary actuator 7, an interlock unit 12, a cylinder lock S and proximity sensors 6 are integrated or arranged at the head 2 of the cylinder tube 3. The proximity sensors 6 sense the position of the head 2 relative to the telescoping sections. By means of the cylinder lock 5, the head 2 can be fixedly connected to a telescoping section. In this arrangement, the cylinder lock 5 is shiftable transversely to the centerline of the cylinder 1, 3 into a corresponding receiving location of each respective telescoping section to thus enable each telescoping section to be shifted relative to the other telescoping sections by means of the piston/cylinder unit 1, 3. The head 2 slides in guide rails 4 for shifting the respective telescoping sections.

Protruding from the cylinder head 2 transversely to the longitudinal centerline of the piston-cylinder unit 1,3 is the rotary actuator 7. Actuator 7 is preferably driven by a rotary drive having, for example, an axle 9. It is around this axle 9 that the cam plate 10 can be turned. The cam plate 10 can be fixed in position by a locking pin 8. The locking pin 8 may be shifted in a direction parallel to its own axis by the rotary actuator 7, and may be extended into a corresponding receiving location in the cam plate 10 (see FIG. 3) parallel to the axle 9 to lock the cam plate. To permit rotation of the cam plate 10, the locking pin 8 is retracted into the rotary actuator 7 and releases the cam plate 10 for turning.

The interlock unit 12 controls and/or actuates the shifting movements of the locking pin 8 and cylinder lock 5. By turning the cam plate 10 around the axle 9, the cam plate 10 can be brought into engagement with the locking bolt 14. In this arrangement, the cylinder head 2 is positioned relative to the locking bolt 14 with the aid of the proximity sensors 6. The locking bolt 14 is bifurcated at its end directed into the interior of the telescoping sections, the two bifurcated ends being bridged by an engaging member 15 extending transversely to the shifting direction of the locking bolt 14. As an entraining pin 15, the engaging member 15 is fixedly connected to the locking bolt 14. Upon rotation around the axle 9, a portion of the cam plate 10 enters the space between the entraining pin 15 and locking bolt 14 and entrains the locking bolt 14 towards the axle 9 of the rotary actuator 7.

Referring to FIG. 8 of the drawings, connected to the guide bushing 13 and the locking bolt 14 is a rotary lock 16 ensuring that the engaging member 15 is always in a suitable radial position for engaging the cam plate 10. As shown in FIG. 8, the rotary lock 16 is configured as a rod 16 connected via a screw thread 29 to the guide bushing 13 at the face of the guide bushing 13 that faces the cam plate 10. In a preferred embodiment the rod 16 can be a screw 16 running through an axial through-hole 30 of the locking bolt 14. Upon assembly, the locking rod 16 is inserted through the through-hole 30 of the locking bolt 14 and subsequently screwed into the screw thread 29 of the guide bushing 13. In the fitted condition, the compression spring 28 urges the locking bolt 14 in the direction of a screw head 31. Upon turning of the threaded rod or screw 16, advancing it towards the axle 9, the threaded rod 16 entrains the locking bolt 14. This achieves the function of an emergency actuator integrated in the bushing 13 and permits actuation (disengagement) of the locking bolt 14 without the rotary actuator 7 and cam plate 10. The locking bolt 14 is mounted in a hole 32 of the guide bushing 13. The presence of the rod 16 in the through-hole 30 makes impossible any rotation of the locking bolt 14 around its own longitudinal centerline. It is particularly preferred that two rotary locks 16 are provided to prevent tilting or canting of the locking bolt 14 within through hole 32.

Figure 3:
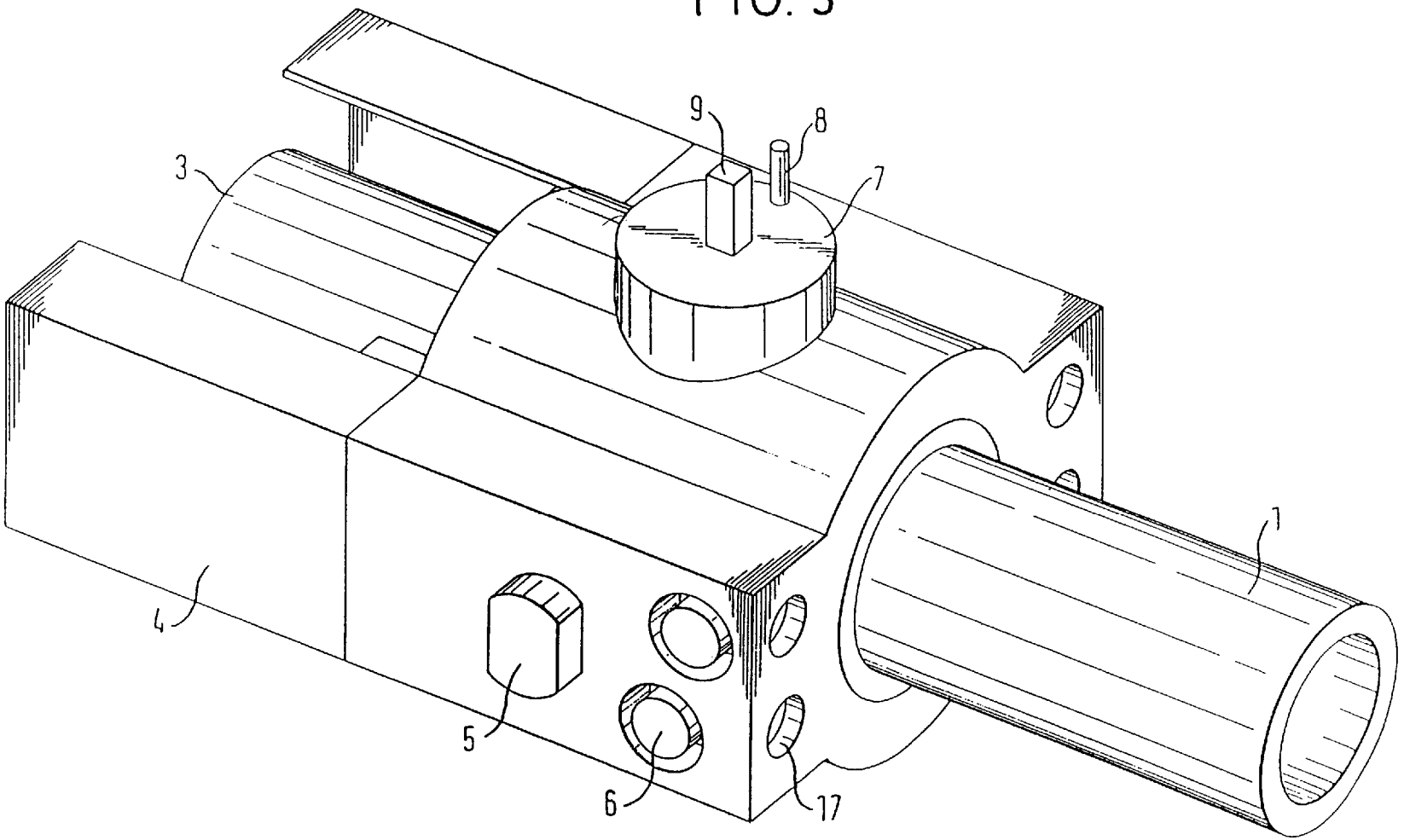
FIG. 3 depicts a piston/cylinder unit with integrated rotary actuator.

FIG. 3 illustrates the piston/cylinder unit with the cam plate 10 removed. The rotary actuator 7 comprises a preferably non-round (i.e., square) axle 9 mounting the cam plate 10 having a correspondingly shaped opening 25 (see FIG. 4) for receiving the axle 9. The locking pin 8 is able to lock the cam plate 10 in a specific position by being axially shifted into a corresponding opening 26 in plate 10 (see FIG. 4).

The cylinder head 2 includes cable guides 17 configured as drilled holes. A compact design of the cylinder head 2 is achieved so that a device as described can be employed in telescoping sections having a relatively small inner diameter to thus ensure, in addition, better protection from mechanical damage.

Figure 4:
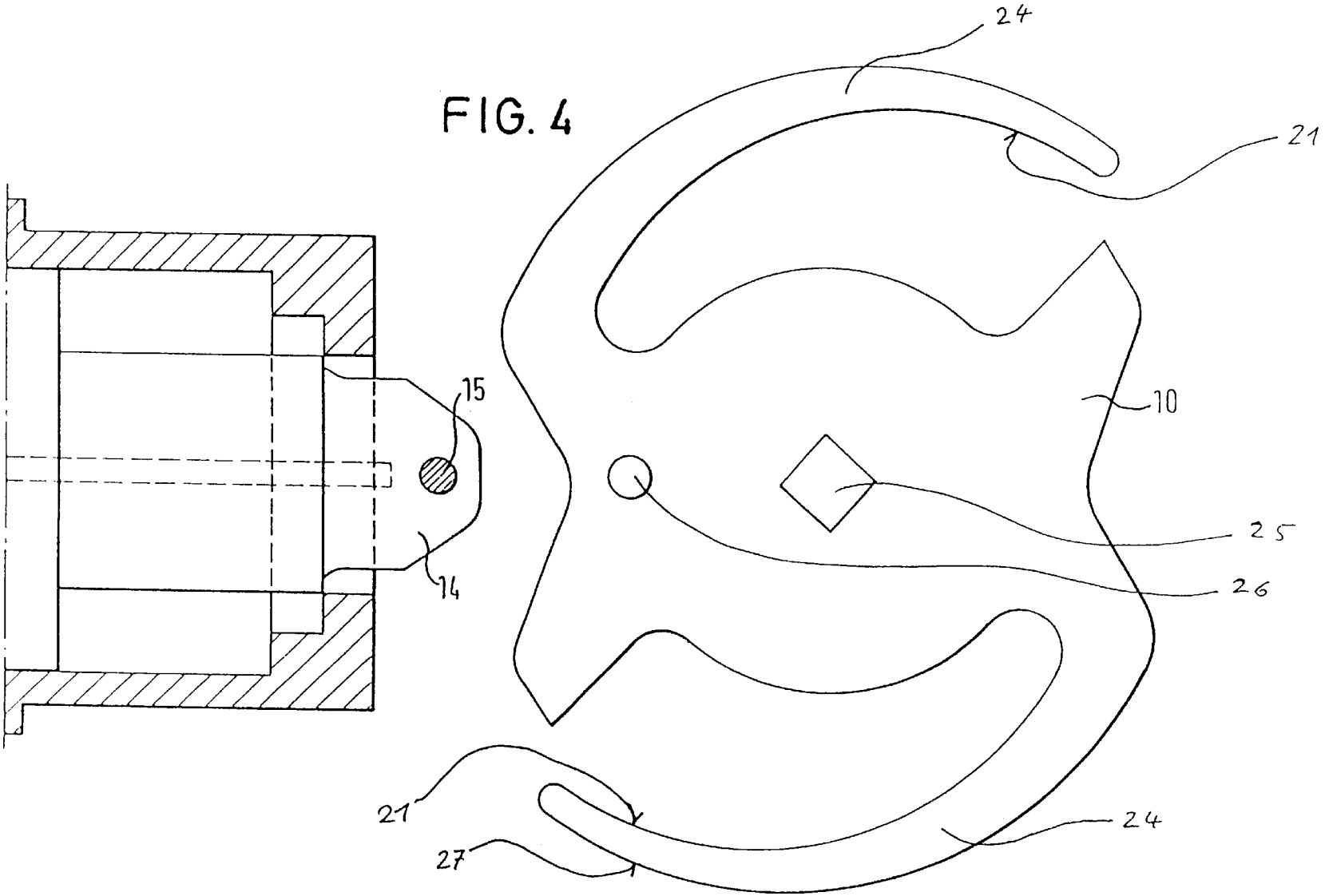
FIG. 4 illustrates an embodiment of a cam plate in accordance with the invention in a passive position and a locking bolt in its extended locked position.

FIG. 4 illustrates the cam plate 10 in its passive position (see FIG. 1 and FIG. 2). The illustrated cam plate 10 comprises two cam claws 24 to simultaneously actuate both locking bolts 14 in an apparatus comprising two such locking bolts. It is to be noted that, for convenience, all figures illustrate only one locking bolt 14.

A cam claw 24 comprises a radial outer surface area 27 and a radial inner surface area 21. In the exemplary embodiment illustrated, the radial inner surface area 21 is configured as a spiral surface area 21 centered at the axle 9 of the cam plate 10. When the cam plate 10 is in its passive position, it can be shifted along the centerline of the telescoping sections without engaging the locking bolt 14. The cam plate 10 as illustrated in FIG. 4 is located in what is termed a 0° position, in which it is configured longer in the direction of the longitudinal centerline of the telescoping sections than it is wide in a direction transverse to such centerline. In the passive position of the cam plate 10, the cylinder head 2, including the release device, can be moved into the telescoping section that is to be extended or retracted. In this passive position, the cam plate is locked by the locking pin 8. The release device has attained a suitable position for releasing the locking bolt 14 when the axes of the locking bolt 14 and the rotational axle 9 of the rotary actuator 7 intersect, as shown in FIG. 4.

Figure 5:
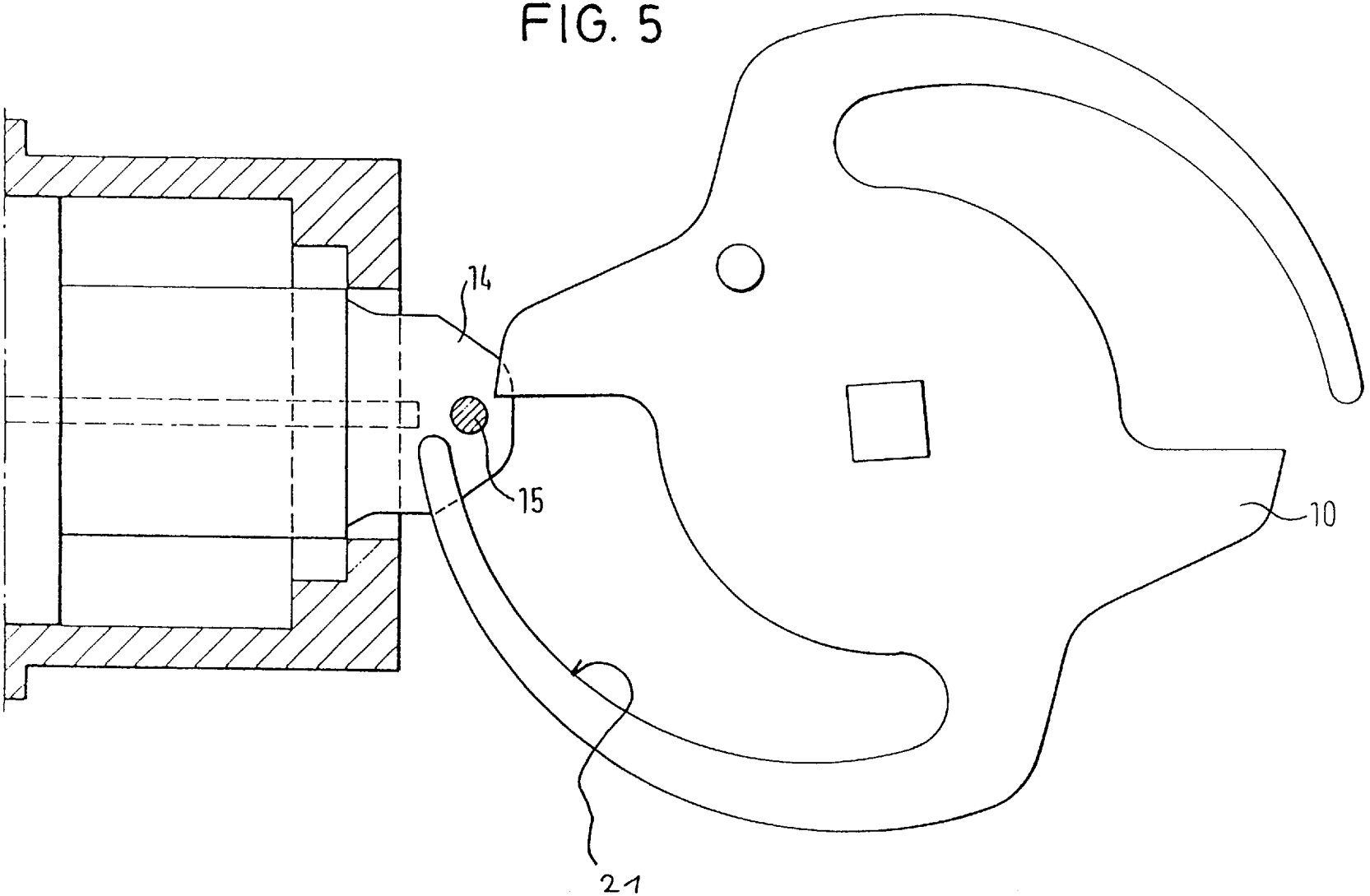
FIG. 5 illustrates the cam plate of FIG. 4 in its active position commencing engagement with the locking bolt in its extended position.
Figure 6:
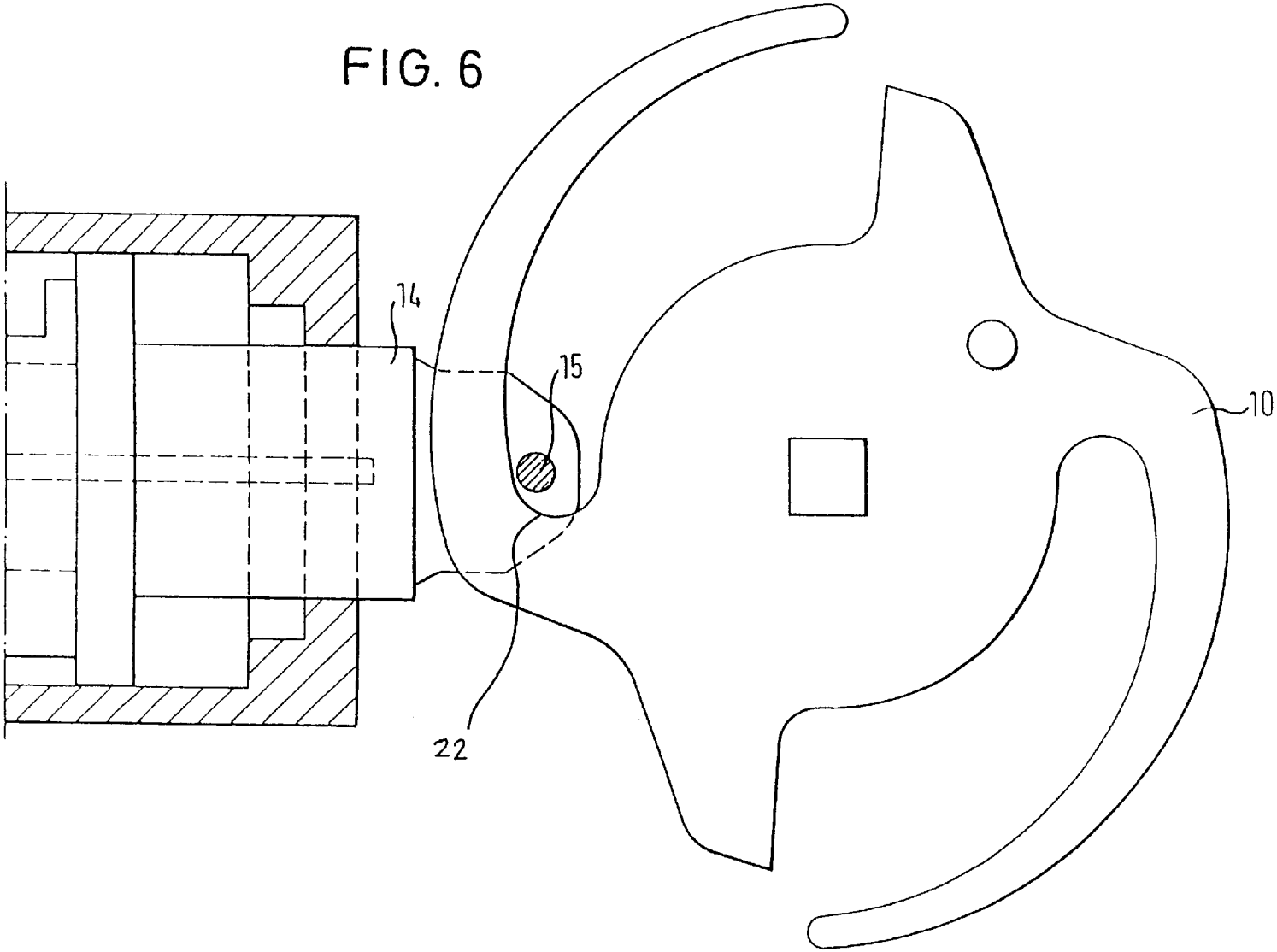
FIG. 6 shows the cam plate of FIGS. 4–5 in a further active position with the locking bolt in its retracted position.

Once such a position of the cylinder head 2 is attained, the cam plate 10 is turned 45° clockwise. In this position the cam claw 24 of the plate 10 commences engagement with the engaging member 15 of the locking bolt 14, as shown in FIG. 5. The locking bolt 14 is at that instant in its extended (locked) position. When the cam plate continues to be turned, such as to a further 90° position, an end position of the cam plate 10 is achieved, as shown in FIG. 6. During this rotation, the entraining pin 15 slides along the spiral inner surface area 21 of claw 24 so that the entraining pin 15 together with the locking bolt 14 is drawn in the direction of the rotational axle 9 of the cam plate 10 against the biasing force of the spring 28.

In FIG. 6, the locking bolt 14 is located in its retracted position. To prevent further rotation of the cam plate 10, the engaging member 15 comes up against an end stop 22 of the cam claw 24. In the illustrated embodiment the stop is located at a 135° position of the cam plate 10.

Figure 7:
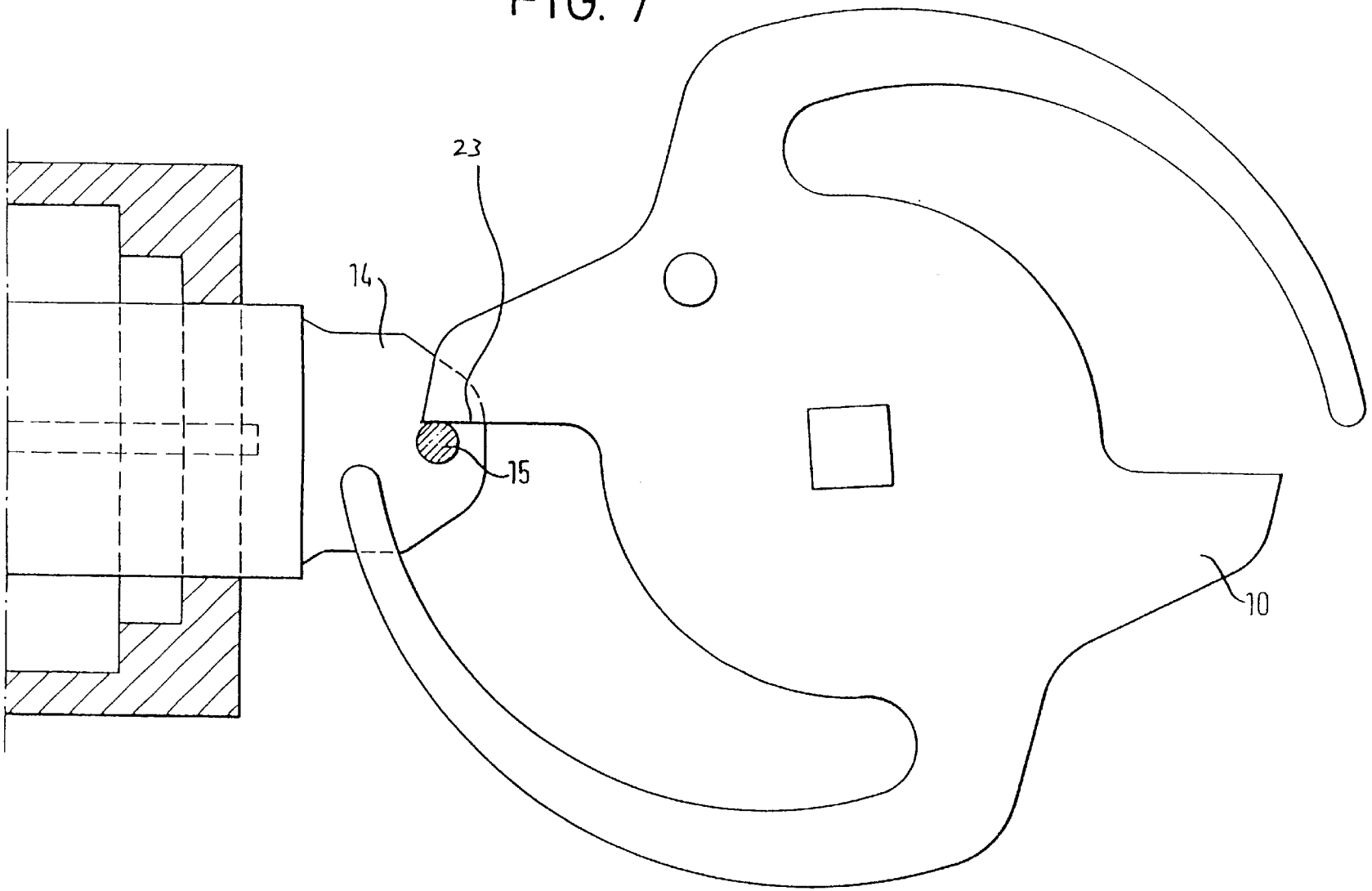
FIG. 7 shows the cam plate of FIGS. 4–6 in its active position commencing engagement with the locking bolt in its retracted position.

When the cam plate 10 is turned from the end position counter-clockwise, the procedure is reversed, and the locking bolt 14 is returned to its extended position by the force of spring 28. Should the locking bolt fail to directly coincide with the receiving location in the outer telescoping section, the locking bolt 14 will not be able to move into its extended position, at least not completely, thus preventing locking between the inner and outer telescoping sections. In this case, it is appropriate for the cam plate 10 not to attain its passive position so that the locking pin 8 cannot be shifted out of location and the cylinder lock 5 cannot disengage from the inner telescoping section 18. The inner telescoping section 18, accordingly, will not be completely freed. For this purpose, the cam plate 10 is provided with a passive stop 23 which will contact the engaging member 15 when the cam plate 10 is rotated from its active position toward its passive position if the locking bolt 14 is not in its fully extended position. This safety position is illustrated in FIG. 7. Thus, only when the two telescoping sections are correctly positioned relative to each other and the locking bolt 14 extends completely and locks the two telescoping sections that the cam plate 10 and cam claw 24 respectively can be moved into the passive position and the locking pin 8 can be shifted out of location to lock the plate in its passive position.

Thus, when an inner telescoping section is to be moved relative to an outer telescoping section, the piston/cylinder unit is moved into a suitable position in which both the cylinder lock 5 and the release device can be effectively actuated. As soon as the piston/cylinder unit has been moved into the suitable position, and this position is confirmed by corresponding sensing means such as proximity sensors 6, the piston/cylinder unit is locked by means of the cylinder lock 5 to the base of the inner telescoping section 18. Upon full extension of the cylinder lock 5, the interlock unit 12 releases movement of the locking pin 8 so that the cam plate 10 is released to rotate. By actuating the rotary actuator 7, the cam plate 10 is rotated and brought into engagement with the engaging member 15. A defined retracting stroke of the locking bolt 14 is attained by appropriately configuring the runway or spiral surface area 21 of the cam plate 10 and by the location of the end stop 22.

The rotary lock 16 assures that the locking bolt 14 always maintains a defined angular position during its axially shifting movement to ensure engagement of cam plate 10 and locking bolt 14 in the outer telescoping section in a defined location. As soon as the end stop 22 has been reached, the sections are released from each other and the inner telescoping section 18 can be shifted relative to the outer telescoping section by the piston/cylinder unit. For this purpose, the cylinder head 2 is fixedly connected to the inner telescoping section via the cylinder lock 5.

Once the inner telescoping section has attained a suitable position, in which it can again be interlocked with the outer telescoping section, the cam plate 10 is rotated in the reverse direction and is again moved into the passive position. By suitably configuring the runway 21 of the cam claw 24 respectively in conjunction with the passive stop 23, it is assured that the passive position can only be attained when the locking bolt 14 has attained its extended position and has thus engaged and locked the inner section to the outer telescoping section. It is not until the passive position of the cam plate 10 has been attained that the locking pin 8 can again be brought into engagement with the cam plate 10 to prevent accidental turning of the cam plate 10. Subsequently, with the inner and outer sections locked to each other, the interlock unit 12 is able to release the cylinder lock 5 and thus the connection between piston/cylinder unit and the inner telescoping section 18. All movements are preferably monitored by sensors and controlled by an external controller.

In the foregoing description, preferred embodiments of the invention have been presented for the purpose of illustration and description. They are not intended to be exhaustive or to limit the invention to the precise form disclosed as modifications or variations are possible in light of the above teachings and within the spirit and scope of the invention.

What is claimed is:

1. A locking mechanism for telescoping sections, comprising at least one locking bolt shiftable linearly between extended and retracted positions for connecting and releasing an inner telescoping section with respect to an outer telescoping section;

a biasing element associated with said locking bolt for biasing the locking bolt to its extended position; and a rotary actuator comprising a spiral surface for engaging and shifting said locking bolt from its extended position to its retracted position.

2. The locking mechanism as set forth in claim 1, wherein said telescoping sections comprise a crane boom.

3. The locking mechanism as set forth in claim 2, wherein said crane boom comprises a piston/cylinder unit including a head portion shiftable along the centerline of said telescoping sections for extending and retracting said telescoping sections, and said rotary actuator is associated with said head portion.

4. The locking mechanism as set forth in claim 1, wherein said rotary actuator includes a connecting element for engaging said locking bolt.

5. The locking mechanism as set forth in claim 3, wherein said connecting element comprises a cam.

6. The locking mechanism as set forth in claim 5, wherein said cam comprises said spiral surface which engages said locking bolt when said rotary actuator is rotated.

7. The locking mechanism as set forth in claim 5, wherein said cam is disengaged from said locking bolt when said locking bolt is in its extended position.

8. The locking mechanism as set forth in claim 7, wherein said rotary actuator is selectively prevented from rotating from a passive position in which said cam is disengaged from said locking bolt.

9. The locking mechanism as set forth in claim 4, wherein said connecting element is disengaged from said locking bolt when said locking bolt is in its extended position.

10. The locking mechanism as set forth in claim 9, wherein said rotary actuator is selectively prevented from rotating from a passive position in which said connecting element is disengaged from said locking bolt.

11. The locking mechanism as set forth in claim 1, further comprising an additional actuator for shifting said locking bolt from its extended position into its retracted position.

12. The locking mechanism as set forth in claim 11, wherein said locking bolt is mounted on one of said telescoping sections; and said additional actuator comprises an actuating element associated with said one telescoping section for shifting the locking bolt.

13. The locking mechanism as set forth in claim 12, wherein said locking bolt is shiftable within a bushing, and said additional actuator is associated with said bushing.

14. The locking mechanism as set forth in claim 13, wherein said additional actuator comprises a pin mounted to said bushing for shifting and selectively positioning said locking bolt.

15. The locking mechanism as set forth in claim 14, wherein said additional actuator defines the limit of travel of said locking bolt in at least one direction.

16. The locking mechanism as set forth in claim 14, wherein said pin is shiftable in a direction parallel to the axis of said locking bolt.

17. The locking mechanism as set forth in claim 16, wherein said pin is threadedly connected to said bushing.

18. The locking mechanism as set forth in claim 13, wherein said additional actuator prevents said locking bolt from rotating.

19. A locking mechanism for telescoping sections, comprising at least a pair of locking bolts shiftable linearly between extended and retracted positions for connecting and releasing an inner telescoping section with respect to an outer telescoping section;

a biasing element associated with each locking bolt for biasing the respective locking bolt to its extended position; and a rotary actuator comprising at least a pair of cam surfaces for simultaneously engaging and shifting said locking bolts from their extended position to their retracted position upon operation of said actuator.

20. The locking mechanism as set forth in claim 19, wherein each said cam surface comprises a spiral surface.

* * * * *